United States Patent [19]

Sööt

[11] Patent Number: 4,815,392

[45] Date of Patent: Mar. 28, 1989

[54] WORK STATION WITH FIXED AND ROTATABLE WORK SURFACES

[76] Inventor: Olaf Sööt, 9 Tomahawk La., Greenwich, Conn. 06830

[21] Appl. No.: 931,717

[22] Filed: Nov. 17, 1986

[51] Int. Cl.[4] ..... A47B 1/00

[52] U.S. Cl. ..... 108/65; 108/94

[58] Field of Search ..... 108/65, 66, 68, 94, 108/95, 139, 104, 103; 186/67

[56] References Cited

U.S. PATENT DOCUMENTS

| | | | |
|---|---|---|---|
| 78,478 | 3/1905 | Davis | 108/65 |
| 732,227 | 6/1903 | Shafer et al. | 108/66 |
| 2,273,006 | 2/1942 | Carlson | 108/69 X |
| 2,536,937 | 1/1951 | Hosea | 108/104 X |
| 2,599,909 | 6/1952 | George | 186/67 |
| 2,933,359 | 4/1960 | Fizdale | 108/66 X |
| 3,073,431 | 1/1963 | Davis et al. | 108/94 X |
| 3,142,521 | 7/1964 | Petroff | 108/94 X |
| 3,635,174 | 1/1972 | Ball et al. | 108/150 |
| 3,682,112 | 8/1972 | Emrick | 108/150 X |
| 3,908,565 | 9/1975 | Burnett | 108/150 X |
| 4,036,150 | 7/1977 | Algier | 108/65 X |
| 4,043,276 | 8/1977 | Dahl | 108/94 X |
| 4,323,291 | 4/1982 | Ball | 108/150 X |
| 4,334,482 | 6/1982 | Bolduc | 108/94 X |
| 4,523,070 | 6/1985 | Jorgenson et al. | 108/139 X |
| 4,555,990 | 12/1985 | Egawa | 108/139 X |
| 4,598,635 | 7/1986 | Clegg | 108/139 X |

FOREIGN PATENT DOCUMENTS

| | | | |
|---|---|---|---|
| 75310 | 9/1917 | Austria | 108/66 |
| 973444 | 10/1964 | United Kingdom | 186/67 |

*Primary Examiner*—Peter A. Aschenbrenner
*Assistant Examiner*—José V. Chen
*Attorney, Agent, or Firm*—Rosen, Dainow & Jacobs

[57] ABSTRACT

A work station in the form of a work table having a fixed working surface and a rotatable working surface, these working surfaces being coplanar. A rigid frame assembly supports both working surfaces and a motor for driving the rotatable working surface by way of a traction wheel. The motor is controlled by a switch situated on the fixed working surface. The working surfaces have hingedly connected side panels to enable the movable table to pass through doorways. Another fixed working surface can be mounted on the rigid frame assembly by way of a post extending through a hole in the rotatable working surface.

16 Claims, 4 Drawing Sheets

WORK STATION WITH FIXED AND ROTATABLE WORK SURFACES

FIELD OF THE INVENTION

The invention relates to a work station for use by handicapped persons with limited mobility wherein their reach can be extended and their access to materials, objects and information required for studying, work or entertainment improved.

The invention further relates to a work station suitable for use while perfoming special tasks, such as assembly of small parts, editing and sorting.

BACKGROUND OF THE INVENTION

When a handicapped person, confined to the wheelchair, has also weakened arms and hands, it is difficult and almost impossible for the person to have access to books and other items without help by others. Tasks such as retrieving reference information which cannot be within the arms' length of the handicapped and even dialing a telephone may become impossible without assistance. An apparatus which would enable the handicapped to move objects to within his reach would minimize the amount of help needed and make the handicapped person more independent.

BRIEF SUMMARY OF THE INVENTION

The invention, a work station in the form of a work table, consists essentially of a circular rotating table portion mounted adjacent to a fixed table portion on a common base structure. The work table includes means for rotating the circular table portion with respect to the fixed table portion, controls, and means for electrical or other utility hookups to the table. It is especially useful as a work table for persons having physical handicaps resulting in limited mobility. By manipulating a switch or by use of voice control, the person sitting at the fixed portion of the table can rotate the circular portion and thus bring the desired objects to within his reach or vision. The objects can be set on the rotating portion of the table as required for performing a particular task (by a helper if the physically handicapped person is unable to do it). After a setup is made, a handicapped person, for example, can work or study independently, without assistance until a change of the setup is required. Thus, independence is provided to the handicapped person for longer periods of time and they can study or perform the tasks required for work with a reduced amount of assistance from others.

BRIEF DESCRIPTION OF THE DRAWINGS

The preferred embodiment of the invention will now be described in detail with reference to the accompanying drawings, wherein.

DETAILED DESCRIPTION OF THE PREFERRED EMBODIMENT

Figure 1:
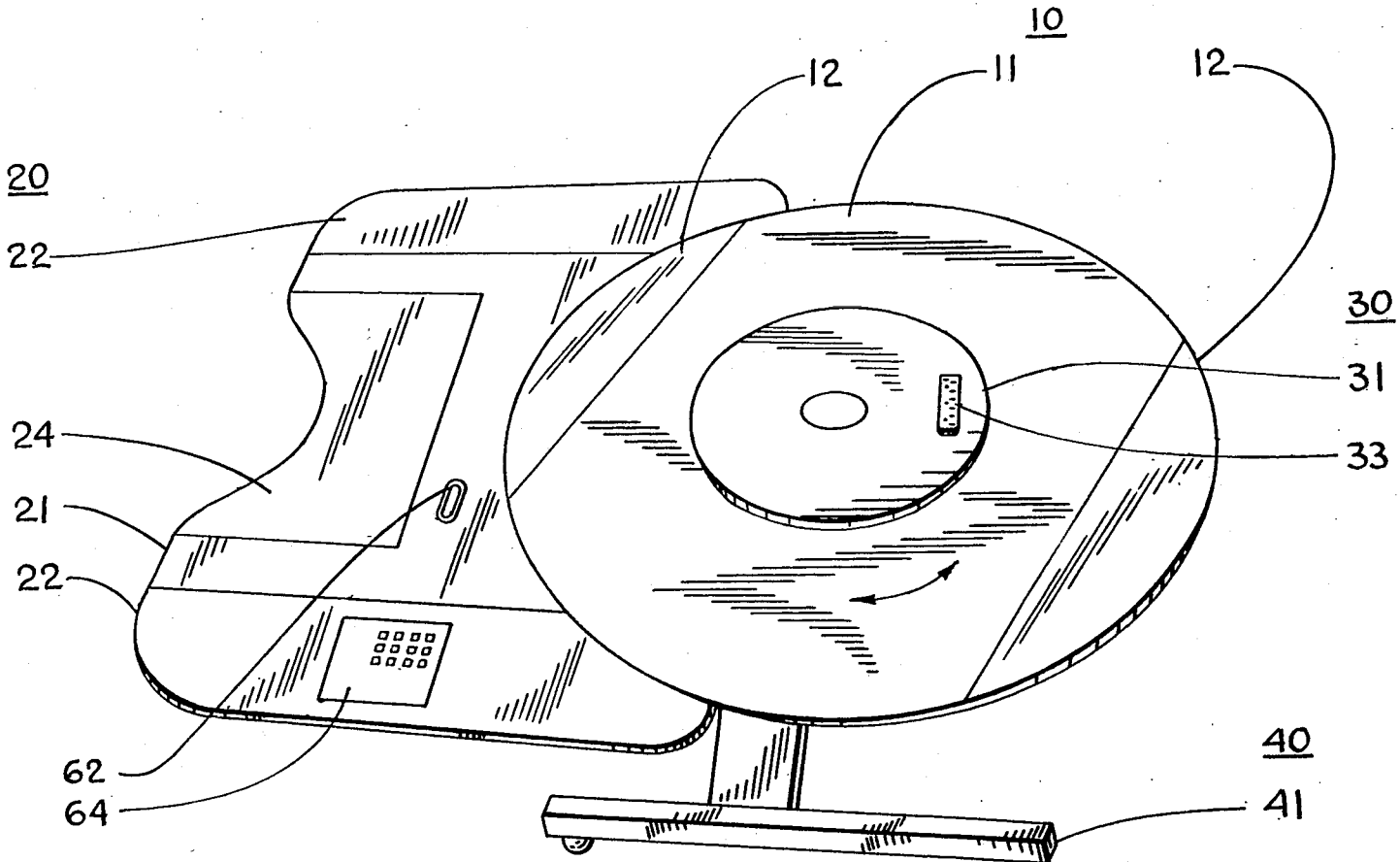
FIG. 1 is a perspective view of the preferred embodiment of the rotating work table, shown ready for use.

Referring to the drawings, FIG. 1 illustrates a perspective view of the rotating work table in accordance with the invention and shows the general arrangement of the circular rotating table 10, the fixed table portion 20, the fixed central pedestal 30 and the base structure 40.

Figure 2:
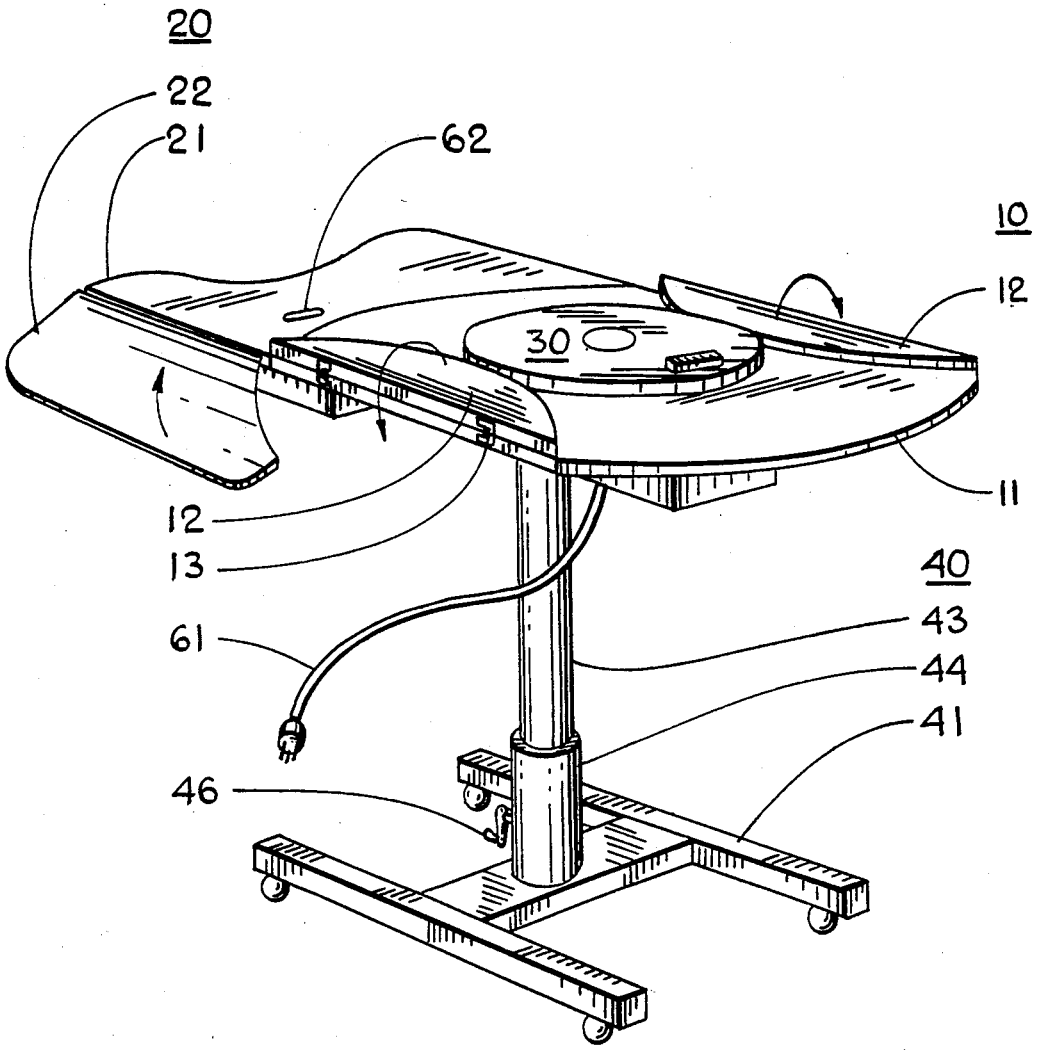
FIG. 2 is another perspective view of the preferred embodiment of the rotating work table, showing the side panels of the circular rotating table portion folded up and the side leaves of the fixed table portion folded down, so as to enable passage through a doorway.

The circular rotating table 10 may be a single circular unit (not shown) or may consist of one center panel 11 and two folding side panels 12. The purpose of this arrangement is to fold the side panels 12 as shown in FIG. 2 to enable passage through doors and narrow spaces when necessary. The side panels 12 can be connected to center panel 11 by means of hinges 13 as shown in FIG. 2.

Figure 3:
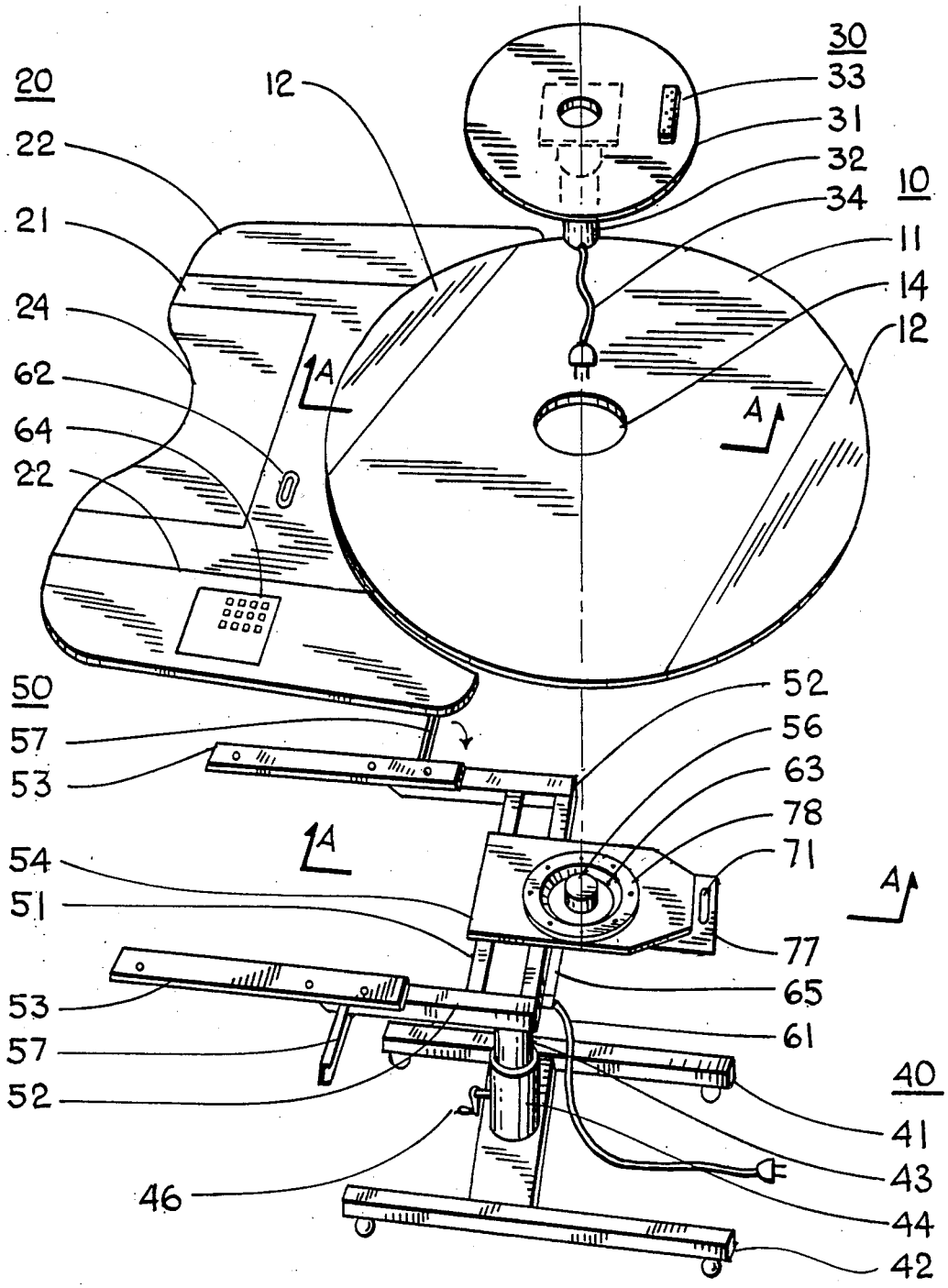
FIG. 3 is an exploded perspective view showing the major components of the preferred embodiment.
Figure 4:
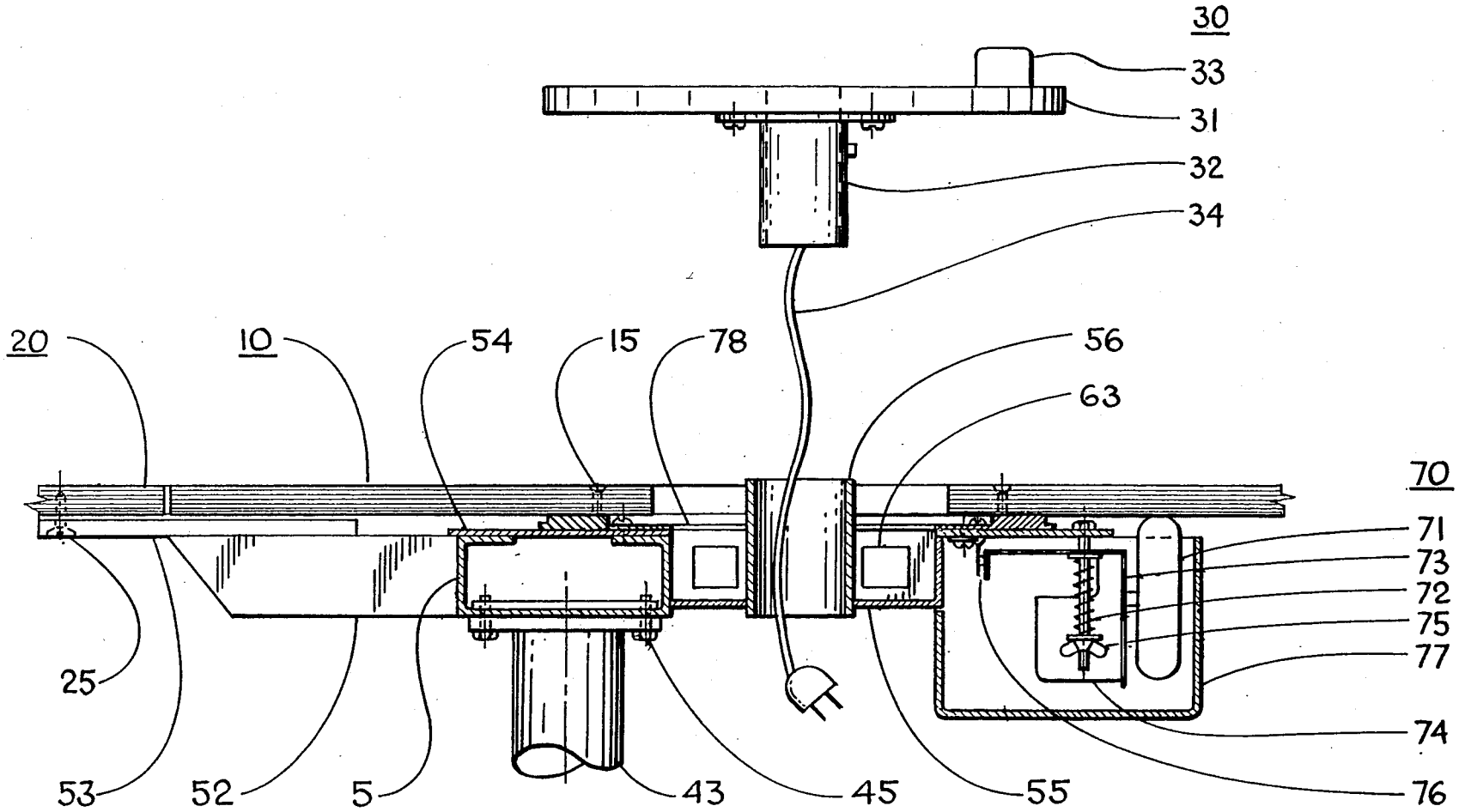
FIG. 4 is a cross-sectional view taken along line A—A in FIG. 3.

Referring now to FIGS. 3 and 4, the circular rotating table 10 is mounted on rotating table bearing 78 by screws 15. The bearing 78 is mounted on top of the bearing mounting plate 54 of top frame assembly 50. The rotating table has a hole 14 in its center to enable the installation of fixed center pedestal 30 above the circular rotating table 10 and into sleeve 56; to provide mounting space and access to the optional collector ring 63 for bringing electricity and/or utilities to rotating table 10; and to allow penetration of electrical wiring for devices which may be placed on fixed center pedestal 30.

The bearing 78 comprises annular inner and outer rings with a row of rolling bodies therebetween, for example, balls.

The fixed table portion 20 can be a single panel (not shown) or can consist of a center panel 21 and two side leaves 22 (see FIGS. 1 and 3), connected to center panel 20 by hinges (not shown). The side leaves 22 can be supported at their up position, level with the center panel 21, by swing arms 57 rotatably mounted on top frame assembly 50 as shown for this particular embodiment in FIG. 3 or by other similar means. The swing arms 57 of the preferred embodiment rotate in the horizontal plane, as indicated by the arrow in FIG. 3. The side leaves 22 can be folded for passage through doors and narrow spaces as shown in FIG. 2.

The fixed table portion 20 is mounted on the flat side arms 53 (see FIGS. 3 and 4) of the top frame assembly 50 by means of screws 25.

An optional removable panel 24, for dedicated equipment, can be incorporated into the fixed table portion 20. Such removable panels 24 can contain computer keyboards or other devices (not shown), flush mounted with the top of the panel 24 so as to provide easy access. Another example of an optional device is the telephone keyboard 64 flush mounted for easy access.

Referring now to FIG. 1, a switching system 62 incorporated in the center panel 21 of the fixed table portion 20 is used to control the rotation of the circular rotating table 10. Additional switching (not shown) can be provided for other functions.

The switching can be accomplished by devices requiring only a slight amount of pressure or touch to activate the control circuits. This is essential because many handicapped persons have only a limited ability to move their hands or apply force required for switching. The switches can be of the highly pressure-sensitive electro-mechanical type. Optical, touch or proximity systems can be used.

Parallel or additional switching and control inputs can be provided for control devices such as blow tubes and light beam pointers for persons who have no ability to use their hands.

In addition to activating and controlling the rotation of the circular rotating table 10, similar switching can be provided for the telephone, for mechanical arms and manipulators (not shown), or for other devices.

FIGS. 3 and 4 further show a preferred embodiment for a fixed center pedestal 30, consisting of a circular plate 31 and center pedestal post 32. The center pedestal 30 is supported by its center post 32 from sleeve 56, part of top frame assembly 50, and can be keyed to sleeve 56 to prevent its rotation. The center pedestal 30 is designed to support objects, such as a table lamp, computer, monitor, television, radio, mechanical arms, manipulators or other special equipment (not shown), which must remain stationary during rotation of the circular rotating table 10. Multi-level center pedestals (not shown) can be used.

In the embodiments shown in FIG. 3, an electric receptacle 33 (i.e. a plurality of sockets) is incorporated in the fixed center pedestal 30. A power cord 34 leading from receptacle 33 can be connected to external power by plugging it into receptacles 65 (i.e. a plurality of sockets) mounted on top frame assembly 50. It is obvious to practitioners of ordinary skill in the art that many embodiments of the fixed center pedestal 30 are possible in order to accomplish different functions.

The circular rotating table 10, fixed table portion 20, fixed center pedestal 30 and top frame assembly 50 are all supported by the base structure 40 as shown in FIG. 3. In addition, a cabinet (not shown) can be supported by the base 41, mounted below the circular rotating table 10. The base structure can be made of steel members or other metals or materials can be used.

In the configuration shown in FIGS. 3 and 4, the base structure 40 consists essentially of a top frame 45, post 43 and base 41. The base 41 is designed to provide the required stability. If used for handicapped persons in wheelchair, its geometry must be such as to allow a wheelchair to fit without intervening with the base 41 or any other part of base structure 40. The base 41 can be supported on the floor by casters 42.

The base 41 may incorporate a sleeve 44 for removably and slidably mounting the post 43. The sleeve can also have provisions for height adjustment. Spacer rings (not shwon) can be used inside the sleeve 44 to support the post 43 at various heights or a mechanical or hydraulic post height adjustment device 46 can be incorporated in the base 41, sleeve 44 or post 43.

Referring now to FIGS. 3 and 4, the top frame assembly 50 shall be mounted on top of post 43 by bolts 45 or by other means. The top frame assembly 50 for the preferred embodiment consists of one center cross member 51, two tubular side arms 52 connected to the ends of center cross member 51, two flat side arms 53 connected to tubular side arms 52, one box member 55 connected to center cross member 51, one bearing mounting plate 54 connected on top of center cross member 51, and one center pedestal sleeve 56 connected to the bottom part of box member 55.

The center cross member 51 is used for supporting the entire top frame assembly 50 from post 43. The tubular side arms 52 and flat side arms 53 are used for supporting the fixed table portion 20. The purpose for changeover from tubular side arms 52 to flat side arms 53 is to provide maximum rigidity near the center cross member 51 and maximum clearance below the fixed table portion 20 for the wheelchair without raising the fixed table portion 20 too high.

The purpose of box member 55 is to provide space and mounting surface for collector ring 63 and to support the center pedestal sleeve 56. If the collector ring 63 is not used, box member 55 can be eliminated and the center pedestal sleeve 56 can be directly supported from bearing mounting plate 54.

The purpose of bearing mounting plate 54 is to support the rotating table bearing 78 and rotating table drive 70.

The center of rotating table 10 is located to clear the post 43 so as to be able to pass the electrical cord 34 and other electrical wiring (not shown) from fixed center pedestal 30 to below the rotating table 10 for plugging into receptacles 65 shown in FIG. 3 or for making other wiring connections below.

The circular rotating table 10 is driven by rotating table drive 70 (see FIG. 4). In the embodiment shown in FIG. 4 the rotating table 10 is driven by a rubber-tired traction wheel 71, mounted to the output shaft of a small gearmotor 74, which gearmotor is in turn mounted to a pivoting drive base 73 and connected to the bearing mounting plate 54 through a hinge 76. This arrangement allows the traction wheel 71 to be pressed against the bottom surface of the circular rotating table 10 by means of springs 72 urging the pivoting drive base 73 to pivot about the hinge 76. The axis of pivoting of hinge 76 is perpendicular to the page in FIG. 4. Thus, necessary traction can be developed for driving the table. The amount of traction can be adjusted by adjusting the compression springs 72 by compression adjustment nuts 75 to a value where slippage would occur between drive wheel 71 and circular rotating table 10 if excessive resistance to rotation is encountered. Other means of driving the rotating table, such as gearing (not shown), can be used. A cover 77 can be provided to enclose the drive 70.

The power is supplied to the table drive 70 and to all switches and electric power receptacles through a plug-in cord 61, attached to receptacle assembly 65, mounted on top frame assembly 50 as shown in FIG. 3.

The benefits offered by the invention have already seen described or will be evident from the foregoing description. Briefly summarized, the invention enables handicapped persons to gain additional independence for studying and working. It is also useful as an assembly device for small parts, editing slide shows (in conjunction with a light stand on the circular portion) and for other similar application.

While the invention has been described in connection with a specific embodiment thereof, those skilled in the art will recognize that various modifications are possible within the principles enunciated herein and thus, the present invention is not limited to the specific embodiments disclosed.

What is claimed is:

1. A work station comprising first, second and third working surface means, support means, bearing means, and mounting means, said first working surfacemeans being fixedly secured to said support means, said second working surface means being fixedly secured to said bearing means, said bearing means being rotatably mounted on said support means, and said third working surface means being supported by said mounting means, said mounting means being fixedly secured to said support means, said bearing means being annular, said annular bearing means having a hole, said second working surface means having a hole overlying said hole of said bearing means, said holes being arranged such that the axis of rotation of said second working surface means passes therethrough, said mounting means extending through said holes of said bearing mens and said second working surface means, driving means hingedly mounted on said support means, and control means electrically connected to actuate said driving means, said driving means being mechanically coupled to rotate said second working surface means in response to actuation by said control means.

2. The work station as defined in claim 1, wherein said control means is securely mounted on said first working surface means.

3. The work station as defined in claim 1, wherein said driving means comprises motor means having a rotatable shaft coupled thereto, traction wheel means mounted on said shaft, said traction wheel means having an outer peripheal surface, base means on which said motor means is mounted, said base means being hingedly connected to said support means, and urging means connected to said support means, said urging means urging said base means in a direction such that said outer peripheral surface of said traction wheel means engages a surface of said second working surface means.

4. The work station as defined in claim 1, wherein said third working surface menas has a hole, and said mounting means has a bore, said hole of said third working surface means being aligned with said bore of said mounting means.

5. A work station comprising first, second and third working surface means, support means, bearing means, and mounting means, said first working surface means being fixedly secured to said support means, said second working surface means being fixedly secured to said bearing means, said bearing means being rotatably mounted on said support means, and said third working surface means being supported by said mounting means, said mounting means being fixedly secured to said support means, said bearing means being annular, said annular bearing means having a hole, said second working surface means having a hole overlying said hole of said bearing means, said holes being arranged such that the axis of rotation of said second working surface means passes therethrough, said mounting means extending through said holes of said bearing means and said second working surface means, said second and third working surface means having substantially parallel top planar working surfaces, said second working surface means having a circular outer periphery of a first diameter and said third working surface means having an outer periphery whose maximum dimension across said outer periphery is smaller than said first diameter.

6. The work station as defined in claim 5 wherein said third working surface means has a circular outer periphery, and the said maximum dimension is the diameter of the third working surface means.

7. The work station as defined in claim 5, wherein said first and second working surface means have coplanar top working surfaces.

8. The work station as defined in claim 7, wherein said second working surface means has an outer periphery comprising a circle of first radius and said first working surface means has an outer periphery comprising a section formed by a circular arc of second radius, said first radius being substantially equal to said second radius, and said first and second working surface means are arranged whereby said section of said outer periphery of said first working surface means circumscribes a corresponding portion of said outer periphery of said second working surface means.

9. The work station as defined in claim 5, wherein said first and second working surface means each comprise a central portion and a pair of collapsible side panels pivotably connected thereto.

10. The work station as defined in claim 9, further comprising means for locking said side panels of said first working surface means in position such that the top working surfaces of said side panels and the top working surface of said central portion of said first working surface means are coplanar, said locking means being pivotably mounted on said support means.

11. The work station as defined in claim 5, wherein said second and third working surface means have substantially parallel top planar working surfaces.

12. The work station as defined in claim 5, further comprising means for adjusting the height of said rigid frame assembly.

13. The work station as defined in claim 5, wherein said first support means further comprises a base assembly having rollers, said rigid frame assembly being supported by said base assembly.

14. The work station as defined in claim 5, wherein said rigid frame assembly has first electrical receptacle means arranged thereon, said third working surface means has second electrical receptacle means arranged thereon, and said third working surface means and said mounting means have means for receiving an electrical connection between said first and second electrical receptacle means.

15. The work station as defined in claim 5, wherein said first working surface means comprises a removable panel.

16. A work station comprising first, second and third working surface means, support means, bearing means, mounting means, driving means, and control means, wherein said first working surface means is fixedly secured to said support means, said second working surface means is fixedly secured to said bearing means, said bearing means being rotatably mounted on said support means, said third working surface means is supported by said mounting means, said mounting means being fixedly secured to said support means and extending through a hole in said second working surface means, said driving means is hingedly connected to said support means, and said control means is electrically connected to actuate said driving means, said driving means being mechanically coupled to rotate said second working surface means in response to actuation by said control means, and said support means comprising a center cross member having first and second ends, first and second side arms respectively connected to said first and second ends of said center cross member, a box member connected to said center cross member, and a bearing mounting plate connected to said center cross member, said bearing means being mounted on said bearing mounting plate, and said mounting means comprises a center pedestal sleeve connected to said box member for supporting said third working surface means, said bearing mounting plate having a hole through which said center pedestal sleeve extends.

* * * * *